US010107100B2

(12) United States Patent
Gaisser

(10) Patent No.: US 10,107,100 B2
(45) Date of Patent: Oct. 23, 2018

(54) VANE CELL MACHINE HAVING A PRESSURE PIECE WHICH DELIMITS TWO PRESSURE CHAMBERS

(71) Applicant: Robert Bosch GmbH, Stuttgart (DE)

(72) Inventor: Gerd Gaisser, Reutlingen (DE)

(73) Assignee: Robert Bosch GmbH, Stuttgart (DE)

( * ) Notice: Subject to any disclaimer, the term of this patent is extended or adjusted under 35 U.S.C. 154(b) by 54 days.

(21) Appl. No.: 15/354,403

(22) Filed: Nov. 17, 2016

(65) Prior Publication Data

US 2017/0138197 A1 May 18, 2017

(30) Foreign Application Priority Data

Nov. 18, 2015 (DE) ..... 10 2015 222 744

(51) Int. Cl.

| | |
|---|---|
| ***F03C 2/00*** | (2006.01) |
| ***F04C 2/00*** | (2006.01) |
| ***F04C 14/18*** | (2006.01) |
| ***F01C 19/02*** | (2006.01) |
| ***F01C 1/344*** | (2006.01) |
| ***F01C 21/08*** | (2006.01) |
| ***F01C 21/10*** | (2006.01) |
| ***F04C 2/344*** | (2006.01) |
| ***F04C 15/00*** | (2006.01) |

(Continued)

(52) U.S. Cl.

CPC ..... *F01C 19/02* (2013.01); *F01C 1/3448* (2013.01); *F01C 21/08* (2013.01); *F01C 21/106* (2013.01); *F04C 2/3442* (2013.01); *F04C 2/3448* (2013.01); *F04C 14/223* (2013.01); *F04C 15/0003* (2013.01); *F04C 15/0034* (2013.01); *F04C 18/3448* (2013.01); *F01C 2021/12* (2013.01)

(58) Field of Classification Search

CPC .. F04C 2/3446; F04C 2/3448; F04C 15/0003; F04C 18/3446; F04C 18/3448; F01C 19/02; F01C 1/3448; F01C 21/08; F01C 21/106; F01C 2021/12

USPC ..... 418/24–28, 31, 259

See application file for complete search history.

(56) References Cited

U.S. PATENT DOCUMENTS

| | | | | |
|---|---|---|---|---|
| 4,392,795 A * | 7/1983 | Smith | ..... | F01C 21/0809 418/259 |
| 4,496,288 A * | 1/1985 | Nakamura | ..... | F04C 14/223 418/31 |
| 4,927,332 A | 5/1990 | Fischer et al. | | |

FOREIGN PATENT DOCUMENTS

| | | | | |
|---|---|---|---|---|
| DE | 32 47 885 C2 | 7/1984 | | |
| JP | 2010101215 A * | 5/2010 | ..... | F04C 2/3446 |

* cited by examiner

*Primary Examiner* — Theresa Trieu

(74) *Attorney, Agent, or Firm* — Maginot, Moore & Beck LLP

(57) ABSTRACT

A vane cell machine includes a housing, rotor, curved ring, spring, and pressure piece. The rotor is configured to rotate about a rotation axis and includes a plurality of plate-like wings that are radially displaceable. The curved ring surrounds the rotor and delimits a movement path of the wings. Each pair of adjacent plate-like wings delimits a corresponding operating chamber. The housing surrounds and enables displacement of the curved ring. The spring is positioned between the curved ring and the housing, is pretensioned, and is configured to load the curved ring. The pressure piece is positioned between the spring and the curved ring, and sealingly abuts the housing and the curved ring so as to delimit a first and second pressure chamber from each other. The housing and the curved ring further delimit the first and second pressure chambers.

13 Claims, 4 Drawing Sheets

(51) Int. Cl.

| | |
|---|---|
| ***F04C 18/344*** | (2006.01) |
| ***F04C 14/22*** | (2006.01) |
| *F01C 21/00* | (2006.01) |

VANE CELL MACHINE HAVING A PRESSURE PIECE WHICH DELIMITS TWO PRESSURE CHAMBERS

This application claims priority under 35 U.S.C. § 119 to patent application no. DE 10 2015 222 744.8, filed on Nov. 18, 2015 in Germany, the disclosure of which is incorporated herein by reference in its entirety.

BACKGROUND

The disclosure relates to a vane cell machine. There is known from U.S. Pat. No. 4,927,332A a vane cell machine which has a rotatable rotor in which a plurality of vanes are received in a radially movable manner. The rotor is surrounded by a curved ring which is in turn surrounded by a housing. A first spring is installed with pretensioning between the housing and the curved ring. Between the curved ring and the first spring, there is arranged a pressure piece by means of which the pressing force of the comparatively large first spring is introduced in a substantially point-like manner into the curved ring.

DE 32 47 885 C2 discloses a vane cell machine in which a total of three pressure chambers are arranged so as to be distributed on the periphery of the curved ring. These are connected to a pressure regulator. They are sealed with respect to each other by means of separate sealing elements.

SUMMARY

An advantage of the present disclosure is that the vane cell machine is constructed in a particularly simple and cost-effective manner. In particular, separate sealing elements for sealing the pressure chambers on the periphery of the curved ring can be dispensed with. Furthermore, two pressure chambers are sufficient to carry out a pressure or volume flow control of the vane cell machine.

According to the disclosure, it is proposed that the pressure piece be in sealing abutment with the housing and the curved ring in such a manner that it delimits a first and a second pressure chamber from each other, wherein the first and the second pressure chambers are further delimited from the housing and the curved ring. Consequently, the separate sealing elements known from DE 32 47 885 C2 can be dispensed with.

A displacement of the curved ring transversely relative to the rotation axis preferably brings about a displacement of the working volume of the vane cell machine. The pressing force of the first spring is preferably directed to a central region of the rotor, wherein it is extremely preferably directed precisely onto the rotation axis of the rotor. The pressure piece may comprise steel or plastics material. Preferably, the pressure piece has a first recess, in which an end of the first spring is received. Preferably, the first pressure chamber is arranged in such a manner that, as a result of the action of pressure thereof, the first spring can be compressed. The sealing engagement between the housing and the pressure piece is preferably constructed in such a manner that the pressure piece is supported so as to be able to be moved in a linear manner on the housing in the direction of the pressing force of the spring.

Advantageous developments and improvements of the disclosure are set out below.

There may be provision for the curved ring at the other side of the pressure piece to be able to be brought into sealing contact with the housing in such a manner that another delimitation of the first and the second pressure chambers is produced. The sealing contact mentioned is preferably produced by means of direct abutment of the curved ring on the housing. Such a sealing contact is particularly cost-effective. Preferably, the first pressure chamber is arranged in such a manner that the curved ring can be brought into sealing contact with the housing by means of application of pressure to the first pressure chamber. Leakages in the sealing contact are thereby minimized.

There may be provision for the housing to have a high-pressure channel and a low-pressure channel which is constructed separately therefrom, which channels as a result of rotation of the rotor can each be brought into fluid exchange connection with the operating chambers, wherein there is provided a pressure regulator which is connected in fluid terms to the first pressure chamber and the high-pressure channel in such a manner that the pressure and/or the volume flow in the high-pressure channel can be controlled by applying pressure to the first pressure chamber. Consequently, the pressure and/or the volume flow of the vane cell machine can be controlled in a particularly simple manner by means of displacement or tilting of the curved ring. Preferably, the pressure regulator is connected to the low-pressure channel in fluid terms.

There may be provision for the second pressure chamber to be connected to the low-pressure channel in fluid terms. This prevents the action on the curved ring of a force which could bring about a cancellation of the sealing contact on the further delimitation of the first and second pressure chambers.

There may be provision for the curved ring to have a circular-cylindrical outer peripheral face which is arranged in parallel opposite a circular-cylindrical inner peripheral face of the housing, wherein there is provided on the outer peripheral face of the curved ring and/or on the inner peripheral face of the housing an abutment continuation at which the curved ring can be brought into sealing contact with the housing in order to delimit the first and second pressure chambers from each other. It is thereby ensured that the further delimitation of the first and the second pressure chambers takes place at a defined location. In this instance, it should be noted that the vane cell machine also functions when the abutment continuation mentioned is not present. However, the size of the pressure chambers and consequently the size of the pressing forces on the curved ring then vary, which prevents a rapid control of the vane cell machine. The abutment continuation is preferably arranged exclusively on the housing so that it is non-movable with respect to the pressure piece. The diameter of the inner peripheral face of the housing is preferably greater than the diameter of the outer peripheral face of the curved ring. Preferably, the curved ring and the housing touch each other directly on the abutment continuation.

There may be provision for the portion of the outer peripheral face of the curved ring which delimits the first pressure chamber to be greater than the portion of the outer peripheral face of the curved ring which delimits the second pressure chamber.

It is thereby possible for the surface-area required for the pivoting action and consequently the control oil volume flow to be effectively reduced.

There may be provision for the abutment continuation to be arranged with respect to the rotation axis with spacing from the pressure piece at an angle which is between 60° and 120°. There are thereby produced on the curved ring particularly favorable pressing forces which bring about, on the one hand, a rapid adjustment of the curved ring and, on the other hand, reliable sealing of the additional delimitation.

The angle mentioned is preferably measured in each case from the center of symmetry of the pressure piece or the abutment continuation. The mentioned angle is preferably between 80° and 100° and extremely preferably 90°.

There may be provision for the pressure piece to engage in the curved ring and the housing in such a positive-locking manner that a rotation of the curved ring with respect to the rotation axis is at least limited. Preferably, a circumferential backlash is provided between the curved ring and the housing. Consequently, a movement of the curved ring transversely relative to the rotation axis is not impeded by the pressure piece. As a result of the internal friction forces, during operation of the vane cell machine, the curved ring is pressed into a defined end position of the circumferential backlash mentioned. However, it is also conceivable for the curved ring to be able to be freely rotated with respect to the housing. However, undesirable wear may thereby result.

There may be provision for the pressure piece to have a first and a parallel second sealing face which are constructed in a planar manner, wherein they are each in abutment with an adapted third or fourth sealing face on the housing, with which face the curved ring is also in abutment. A portion of the above-proposed sealing between the housing and pressure piece is thereby achieved in a particularly simple and cost-effective manner. The third and fourth sealing faces are preferably constructed in a planar manner, wherein they are extremely preferably arranged perpendicularly relative to the rotation axis.

There may be provision for the pressure piece to have a fifth and a parallel sixth sealing face which face away from each other, wherein they are each in abutment with an adapted seventh or eighth sealing face on the housing, wherein the first, the fifth, the second and the sixth sealing faces surround the pressure piece in the given sequence in an endless and continuous manner. A complete sealing between the housing and pressure piece is thereby achieved in a particularly simple manner. The fifth and the sixth sealing face are preferably constructed in a planar manner, wherein they extremely preferably extend parallel with the rotation axis. The fifth and the sixth sealing faces preferably extend parallel with the pressing force of the first spring. The pressure piece is thereby guided so as to be able to be moved in a linear manner on the housing in the direction of the pressing force of the first spring.

There may be provision for the housing to be composed of a first, a second and a third housing portion which are constructed separately from each other, wherein the third sealing face is arranged on the first housing portion, wherein the fourth sealing face is arranged on the third housing portion, wherein the seventh and the eighth sealing faces are arranged on the second housing portion. Good sealing is thereby achieved in the corner regions of the pressure piece in a particularly simple manner. The relevant corners of the pressure piece are preferably constructed with sharp edges. The first, the second and the third housing portions are preferably securely connected to each other, extremely preferably by means of screws.

There may be provision for the pressure piece to have a ninth sealing face which is in sealing abutment with an adapted region of the outer peripheral face of the curved ring. The above-proposed sealing between the pressure piece and the curved ring is thereby achieved in a simple and cost-effective manner. The ninth sealing face is preferably directly in abutment with the curved ring. The ninth sealing face is preferably constructed in a concave circular-cylindrical or planar manner. The adapted region is preferably constructed in a convex circular-cylindrical manner, wherein it extremely preferably has a smaller radius of curvature than the ninth sealing face.

Of course, the features which are mentioned above and those which are intended to be explained below can be used not only in the combination set out in each case, but also in other combinations or alone, without departing from the scope of the present disclosure.

BRIEF DESCRIPTION OF THE DRAWINGS

The disclosure is explained in greater detail below with reference to the appended drawings, in which.

DETAILED DESCRIPTION

Figure 1:
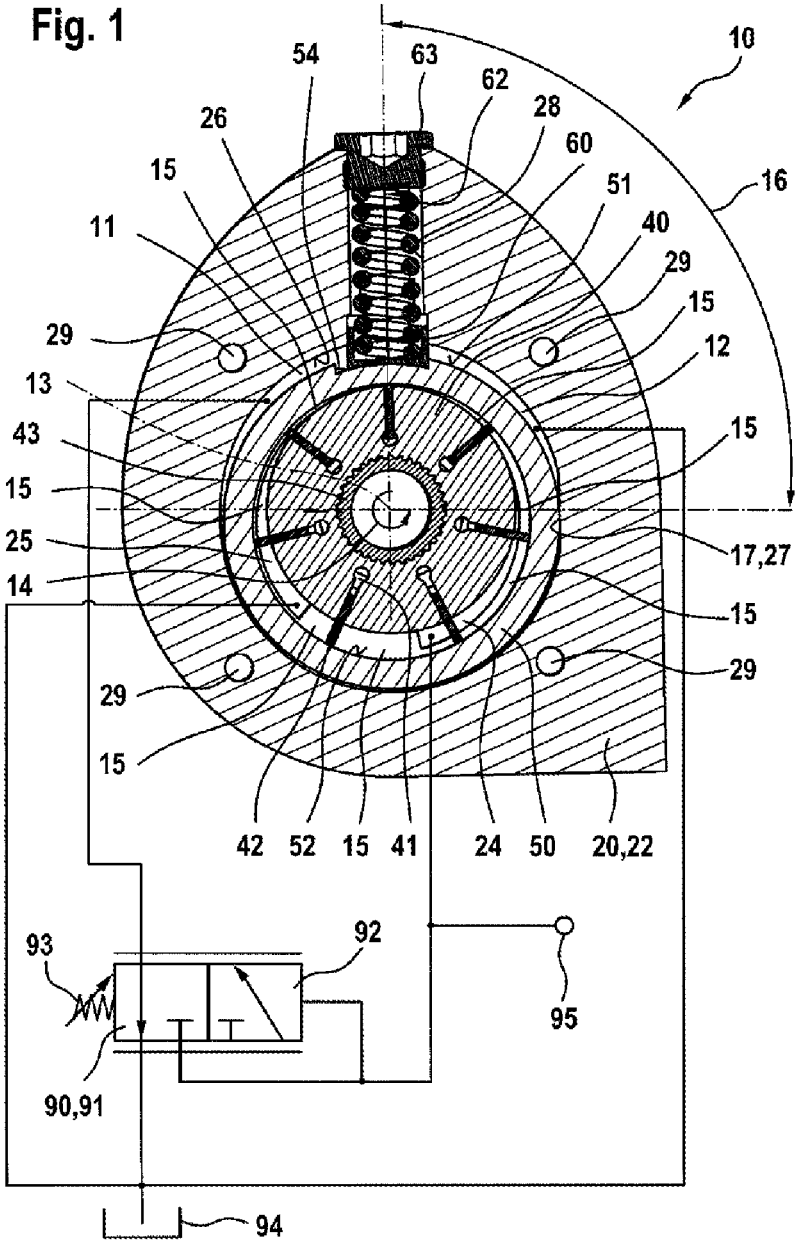
FIG. 1 is a cross-section of a vane cell machine according to the disclosure.

FIG. 1 is a cross-section through a vane cell machine 10 according to the disclosure. The vane cell machine 10 has a rotor 40 which is supported in a housing 20 so as to be able to be rotated with respect to a rotation axis 13. The plane of section of FIG. 1 extends perpendicularly relative to the rotation axis 13 centrally through the rotor 40. Within the rotor 40, there is arranged in this instance a separate drive shaft 43 which protrudes with a drive journal out of the housing 20 so that it can, for example, be caused to move in rotation by an electric motor. The rotor 40 is connected in this instance to the drive shaft 43 by means of a multiple-spline profile. In the rotor 40, a plurality, for example, seven, plate-like wings 42 are movably received radially with respect to the rotation axis 13. The rotor 40 is surrounded by a curved ring 50 which limits the movement path of the wings 42 in an outward direction. The wings 42 are pressed against the curved ring 50 by means of centrifugal forces when the rotor 40 is rotated. There is further associated with each wing 42 radially at the inner side a rear wing space 41 which is further delimited from the rotor 40 and the housing 20. This may be acted on with pressurized fluid, for example, from the high-pressure channel 24, in order to press the relevant wing 42 against the curved ring 50.

Two adjacent wings 42 each delimit an operating chamber 15 which is further delimited from the rotor 40, the curved ring 50 and the housing 20 in such a fluid-tight manner that a pressurized fluid exchange with the operating chambers 15 is possible only via the high-pressure or low-pressure channel 24; 25. In this case, FIG. 1 shows only a portion of the kidney-shaped mouth opening of the high-pressure and the low-pressure channels 24, 25, wherein in FIG. 2 the entire mouth opening can be seen.

In this instance, the curved ring 50 has a circular-cylindrical inner peripheral face 52 so that the wings 42 carry out a single stroke cycle when the rotor 40 rotates. Of course, the inner peripheral face 52 of the curved ring 50 may also be constructed in such a manner that the wings 42 carry out a plurality of stroke cycles when the rotor 40 rotates. The curved ring 50 has a circular-cylindrical outer peripheral face 51 which is arranged concentrically relative to the inner peripheral face 52 thereof, wherein the corresponding center axis is orientated parallel with the rotation axis 13. The two side faces (No. 53 in FIG. 2) are constructed in a planar manner, wherein they are orientated perpendicularly with respect to the rotation axis 13. The corresponding width of the curved ring 50 is equal to the width of the wings 42 and equal to the width of the rotor 40 so that the components mentioned can be sealed together with respect to a planar third or fourth sealing face (No. 73 in FIG. 3; No. 74 in FIG. 2) on the housing 20. The curved ring 50 is movably received in the housing transversely relative to the rotation axis 13 so that the stroke path of the wings 42 can be adjusted by means of a displacement or tilting of the curved ring 50.

There is further provided in the outer peripheral face 51 of the curved ring 50 a groove 54 which extends through the curved ring 50 in the direction of the rotation axis 13 over the entire width thereof with a constant substantially rectangular cross-sectional shape. A pressure piece 60 engages in this groove 54 in a positive-locking manner so that the curved ring 50 is secured against rotation about the rotation axis 13. In this instance, the width of the groove 54 is greater than the spacing of the associated fifth and sixth sealing faces (No. 75; 76 in FIG. 2) on the pressure piece 60. Accordingly, the curved ring 50 has a circumferential backlash, wherein it is pressed during operation of the vane cell machine 10 by means of internal friction forces into an end position. FIG. 1 shows the relationships for a rotation direction 14 of the rotor 40 which is directed in a counterclockwise direction in FIG. 1. Accordingly, the pressure piece 60 is in abutment with the right lateral edge of the groove 54 in FIG. 1. It is conceivable for the groove 54 to be dispensed with so that the curved ring 50 rotates during operation in the housing 20.

When the vane cell machine 10 is operated as a vane pump, pressurized fluid, in particular hydraulic oil, is drawn via the low-pressure channel 25, for example, from a tank 94. The mouth opening of the low-pressure channel 25 is in this instance arranged in the region of the operating chambers 15 whose volume increases when the rotor 40 is rotated. The pressurized fluid from the operating chambers 15, whose volume decreases when the rotor 40 is rotated, is conveyed through the high-pressure channel 24 to an operating connection 95 of the vane cell machine 10. The peripheral spacing of the kidney-shaped mouth openings of the high-pressure and low-pressure channel 24; 25 is constructed to be greater than the width of an operating chamber 15 so that a pressure short-circuit between the high-pressure and the low-pressure channel 24; 25 is prevented in each rotation position of the rotor 40.

There are arranged on the outer peripheral face 51 of the rotor 40 a first and a second pressure chamber 11; 12 which are further delimited from the housing 20 and the pressure piece 60 in a fluid-tight manner. The inner peripheral face 26 of the housing 20, which is opposite the outer peripheral face 51 of the curved ring 50 in a parallel manner, is preferably constructed in a circular-cylindrical manner, wherein the corresponding cylinder axis preferably coincides with the rotation axis 13. On the inner peripheral face 26 of the housing 20 there is constructed an abutment continuation 27 which is constructed in this instance in a planar manner, wherein it may also be curved in a convex manner. During operation, the outer peripheral face 51 of the curved ring 50 is in abutment with the abutment continuation 27 in a fluid-tight manner, wherein the curved ring 50 is pressed by the pressure in the operating chambers 15 against the abutment continuation 27. The sealing on the abutment continuation 27 forms one of two delimitations of the first and the second pressure chambers 11; 12 in a peripheral direction with respect to the rotation axis 13. It is conceivable to dispense with the abutment continuation 27, wherein the location of the sealing is then no longer precisely defined.

The extent of the abutment continuation 27 is preferably selected in such a manner that the first pressure chamber 11 in each possible position of the curved ring 50 in which it is in abutment with the abutment continuation 27 extends through more than 180° over the periphery of the curved ring 50. This results in the pressure acting counter to the spring 62 being partially compensated for, which enables smaller sizing of this spring 62. Furthermore, the fluid flow required for adjustment of the curved ring is reduced.

The pressure piece 60 is arranged with respect to the rotation axis 13 remote from the abutment continuation 27 by an angle 16 which in this instance is 90°. In this instance, this is the most favorable angle, wherein the vane cell machine 10 can also operate with different angles 16. The pressure piece 60 forms in the peripheral direction with respect to the rotation axis 13 the second of the two fluid-tight delimitations between the first and the second pressure chambers 11; 12 whose structural configuration is explained in greater detail with reference to FIGS. 2 and 3.

The pressure piece 60 is acted on by the force of a pretensioned first spring 62. The first spring 62 is constructed as a helical spring, wherein it is received in a first hole 28 of the housing 20. The direction of the first hole 28 coincides with the movement direction of the pressure piece 60, wherein the pressure piece 60 is guided radially with respect to the rotation axis 13 so as to be able to be moved in a linear manner on the housing 20. The first hole 28 is closed in a fluid-tight manner by a screw 63, wherein the first spring 62 is supported on the screw 63.

In FIG. 1, there is illustrated purely by way of example a particularly simple pressure regulator 90, with reference to which the operation of the first and the second pressure chambers 11; 12 is intended to be explained. The pressure regulator 90 can constantly be adjusted between a first and a second position 91; 92. It is acted on by means of a second spring 93 in the direction of an adjustment toward the first position 91. In the opposite direction, it is acted on by the pressure at the operating connection location 95 or the pressure in the high-pressure channel 24. The pretensioning or the pressure equivalent of the second spring 93 can constantly be adjusted so that the conveying pressure of the vane cell machine 10 can be adjusted.

When the pressure in the high-pressure channel 24 is lower than the adjusted pressure, the pressure regulator 90 is adjusted in the direction of the first position 91, wherein the first pressure chamber 11 is connected to the tank 94. Consequently, the first spring 62 adjusts the curved ring 50 in the direction of a larger working volume so that the pressure in the high-pressure channel 24 increases. As soon as this is greater than the pressure adjusted at the second spring 93, the pressure regulator 90 is adjusted in the direction of the second position 92, whereby the first pressure chamber 11 is acted on with the pressure in the high-pressure channel 24. The curved ring 50 is thereby adjusted in the direction of a smaller working volume, whereby the pressure in the high-pressure channel 24 is reduced. Consequently, the pressure in the high-pressure channel 24 is adjusted to the pressure equivalent of the second spring 93.

The second pressure chamber 12 is preferably connected in fluid terms to the low-pressure channel 25 so that the curved ring 50 is substantially not acted on with a pressing force from the second pressure chamber 12.

Figure 2:
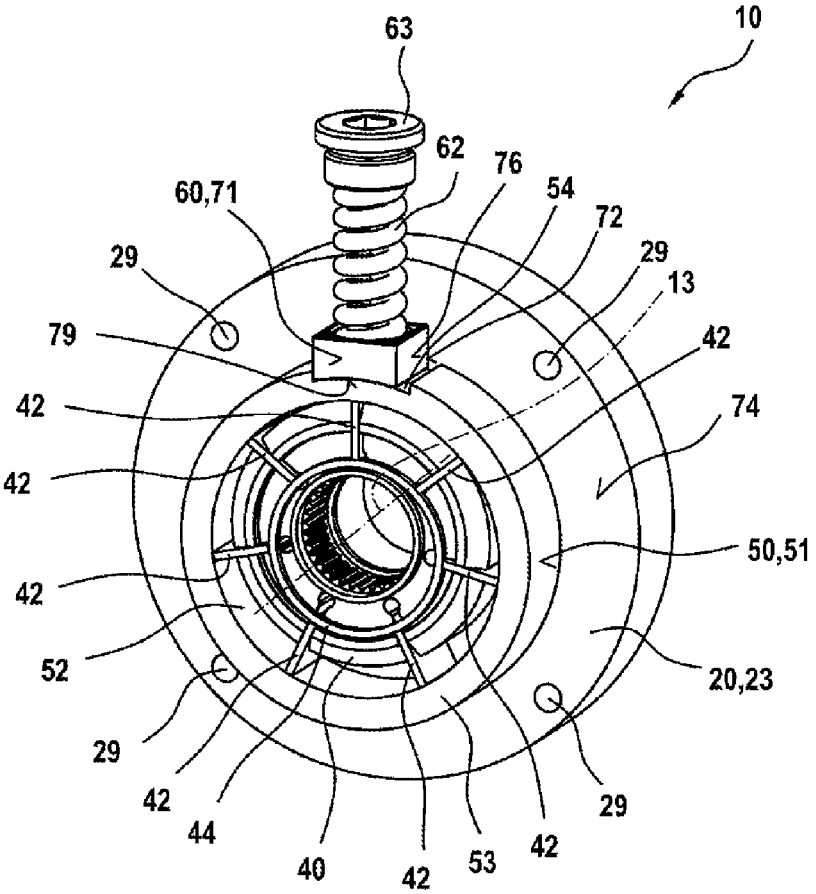
FIG. 2 is a perspective view of a first partial subassembly of the vane cell machine according to FIG. 1.
Figure 3:
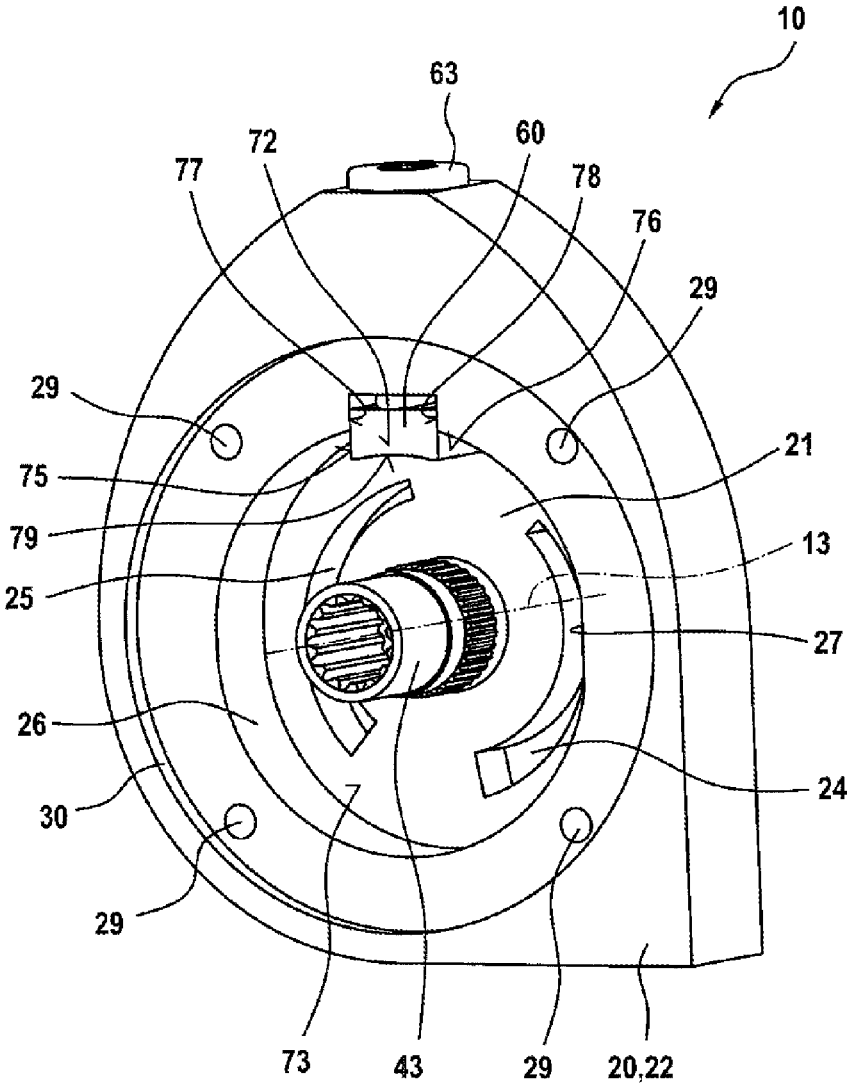
FIG. 3 is a perspective view of a second partial subassembly of the vane cell machine according to FIG. 1.

The second holes 29, which are each arranged in alignment in the first, second and third housing portions (No. 21; 22 in FIG. 3; No. 23 in FIG. 2) should also be noted. Screws, which securely hold together the housing portions mentioned preferably extend through them.

FIG. 2 is a perspective view of a first part-subassembly of the vane cell machine 10 according to FIG. 1. The first part-subassembly comprises the third housing portion 23, which is constructed substantially in the form of a planar plate which has a constant thickness and which has a circular external outline with respect to the rotation axis 13. A passage for the drive shaft (No. 43 in FIG. 3) is arranged in the center of the third housing portion 23. The third housing portion 23 forms a planar fourth sealing face 74 which is orientated perpendicularly relative to the rotation axis 13. The rotor 40, all the wings 42 and the curved ring 50 are in sealing abutment with the fourth sealing face 74 with planar counter-faces. The pressure piece 60 has a planar second sealing face 72 which is also in abutment with the fourth sealing face 74. The corresponding pair of faces forms a portion of the sliding guide which defines the movement direction of the pressure piece 60 which is orientated radially with respect to the rotation axis 13.

It can further be seen in FIG. 2 that the pressure piece 60 has a planar first sealing face 71 which is arranged parallel with the second sealing face 72, wherein it faces away therefrom. The first sealing face 71 is in sealing abutment with a third sealing face (No. 73 in FIG. 3), which is arranged on the first housing portion (No. 21 in FIG. 3). The rotor 40, all the wings 42 and the curved ring 50 are also in sealing abutment with the third sealing face (No. 73 in FIG. 3) with adapted planar sealing faces.

Furthermore, the pressure piece 60 has at the side facing the curved ring 50 a ninth sealing face 79 which is preferably constructed in a circular-cylindrical manner with respect to the rotation axis 13. Of course, this condition is complied with only in one position of the pressure piece 60, preferably in the position in which it is arranged radially furthest outward. On the curved ring 50 there is provided a counter-face which is also circular-cylindrical and which is preferably arranged on the base of the groove 54. The radius of curvature of this counter-face is preferably minimally smaller than the radius of curvature of the ninth sealing face 79. It is thereby ensured in all positions of the curved ring 50 that a linear sealing is carried out on the ninth sealing face 79.

The pressure rings 44 which are each arranged at both opposing sides of the rotor 40 should also be noted. They are installed in a sealing manner between the rotor 40 and the third or fourth sealing face, wherein they are radially inwardly in abutment with the wings 42. Using the pressure rings 44, it is ensured that the wings 42 are also in abutment with the curved ring 50 when the vane cell machine 10 rotates in a pressure-free state or when the rotor 40 does not rotate or rotates only very slowly.

FIG. 3 is a perspective view of a second part-subassembly of the vane cell machine 10 according to FIG. 1. This substantially forms the counter-piece to the first part-subassembly according to FIG. 2, wherein the pressure piece 60 is illustrated both in FIG. 2 and in FIG. 3.

The pressure piece 60 has a fifth and a sixth sealing face 75; 76 which are constructed in this instance in a planar manner and parallel with each other, wherein they face away from each other. The fifth and the sixth sealing faces 75; 76 may alternatively also define a common circular cylinder, wherein additional different forms are conceivable. Preferably, the pressure piece 60 is in abutment with the housing 20 in an endless and continuous manner over the entire periphery thereof, which is defined by the first, the fifth, the second and the sixth sealing faces 71; 75; 72; 76, so that no pressurized fluid can pass through at that location.

The first housing portion 21 is also constructed in the form of a planar plate which has a constant thickness and which has a circular external outline with respect to the rotation axis 13. The first housing portion 21 and the third housing portion (No. 23 in FIG. 2) are each received in an associated centering recess 30. FIG. 3 shows that the base of the centering recess 30 is arranged in alignment with the second sealing face 72 on the pressure piece 60. Accordingly, the fourth sealing face (No. 74 in FIG. 2) which is positioned at that location is in abutment with the second sealing face 72.

The first housing portion 21 is provided with an aperture for the drive shaft 43. Furthermore, the high-pressure and low-pressure channels 24; 25 are arranged on the first housing portion 21, wherein in FIG. 3 only the mouth openings which are constructed in kidney-like form with respect to the rotation axis 13 can be seen.

Figure 4:
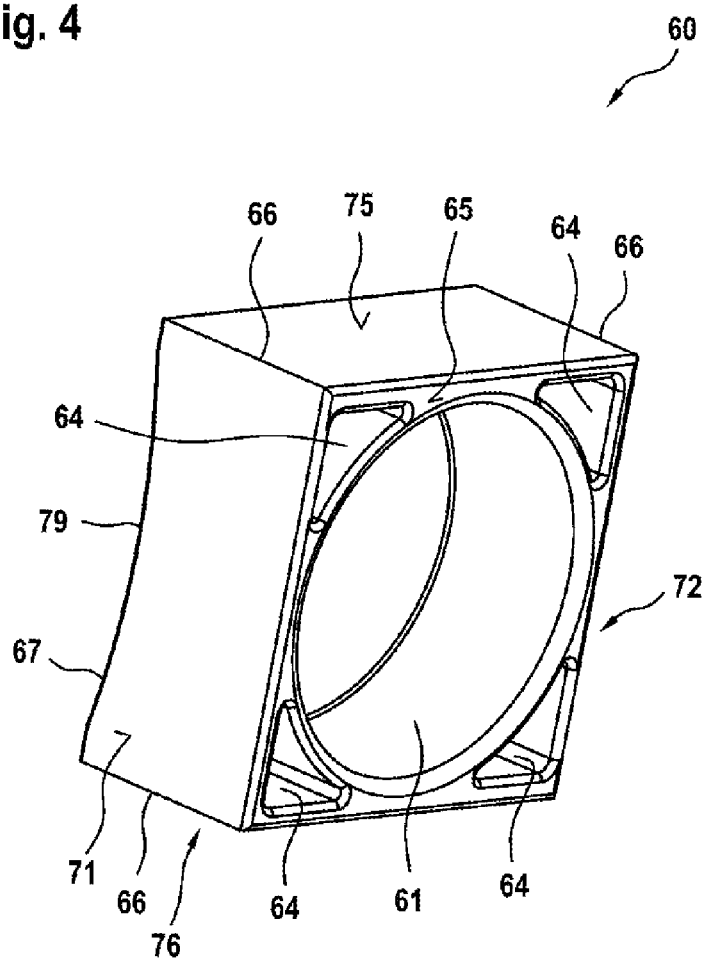
FIG. 4 is a perspective view of the pressure piece.

FIG. 4 is a perspective view of the pressure piece 60. The first, the fifth, the second and the sixth sealing faces 71; 75; 72; 76 together form a rectangular, preferably a square, cross-section which extends in a constant manner over the entire height of the pressure piece 60. The corresponding corners 66 are constructed to have sharp edges so that a pressure-tight sealing is also provided at that location. The pressure piece 60 does not protrude beyond the planes which are defined by the sealing faces 71; 75; 72; 76 mentioned.

The ninth sealing face is orientated at the center perpendicularly to the remaining sealing faces 71; 75; 72; 76, wherein it is constructed in a continuous manner. The corners 67 at the first or second sealing face 71; 72 are also constructed with sharp edges so that a pressure-tight sealing is also provided at that location. At the opposite side, the pressure piece is provided with a circular-cylindrical first recess 61 which is arranged centrally in the pressure piece 60. One end of the first spring (No. 62 in FIG. 1) is received in the first recess 61. In the four corner regions of the pressure piece 60, there is arranged in each case a second recess 64 which substantially serves to save material.

The pressure piece 60 preferably comprises plastics material, wherein it is extremely preferably produced with the injection-molding method. However, it is also conceivable for the pressure piece 60 to be produced from metal, in particular from steel.

LIST OF REFERENCE NUMERALS

10 Vane cell machine
11 First pressure chamber
12 Second pressure chamber
13 Rotation axis
14 Rotation direction
15 Operating chamber
16 Angle
17 Additional delimitation
20 Housing
21 First housing portion
22 Second housing portion
23 Third housing portion
24 High-pressure channel
25 Low-pressure channel
26 Inner peripheral face of the housing
27 Abutment continuation
28 First hole
29 Second hole

30 Centering recess
40 Rotor
41 Rear wing space
42 Wing
43 Drive shaft
44 Pressure ring
50 Curved ring
51 Outer peripheral face of the curved ring
52 Inner peripheral face of the curved ring
53 Side face of the curved ring
54 Groove
60 Pressure piece
61 First recess
62 First spring
63 Screw
64 Second recess
65 Head face
66 Corner
67 Corner
71 First sealing face
72 Second sealing face
73 Third sealing face
74 Fourth sealing face
75 Fifth sealing face
76 Sixth sealing face
77 Seventh sealing face
78 Eighth sealing face
79 Ninth sealing face
90 Pressure regulator
91 First position
92 Second position
93 Second spring
94 Tank
95 Operating connection location

What is claimed is:

1. A vane cell machine, comprising:

a rotor that is configured to rotate about a rotation axis;

a plurality of plate-like wings received in the rotor so as to be displaceable radially relative to the rotation axis, each pair of adjacent plate-like wings defining a corresponding operating chamber;

a curved ring that surrounds the rotor, and that delimits a movement path of the plate-like wings in an outward direction relative to the rotation axis;

a housing that surrounds the curved ring, and that enables displacement of the curved ring transversely relative to the rotation axis;

a first spring that is positioned between the curved ring and the housing, that is pretensioned, and that is configured to exert a first spring force that loads the curved ring transversely relative to the rotation axis; and a pressure piece that is positioned between the first spring and the curved ring, and that sealingly abuts the housing and the curved ring to delimit a first pressure chamber and a second pressure chamber from each other, wherein the housing and the curved ring further delimit the first pressure chamber and the second pressure chamber, and wherein an opposite side of the curved ring located radially opposite the pressure piece sealingly contacts the housing so as to delimit the first pressure chamber and the second pressure chamber.

2. A vane cell machine, comprising:

a rotor that is configured to rotate about a rotation axis;

a plurality of plate-like wings received in the rotor so as to be displaceable radially relative to the rotation axis, each pair of adjacent plate-like wings defining a corresponding operating chamber;

a curved ring that surrounds the rotor, and that delimits a movement path of the plate-like wings in an outward direction relative to the rotation axis;

a housing that surrounds the curved ring, and that enables displacement of the curved ring transversely relative to the rotation axis;

a first spring that is positioned between the curved ring and the housing, that is pretensioned, and that is configured to exert a first spring force that loads the curved ring transversely relative to the rotation axis; and a pressure piece that is positioned between the first spring and the curved ring, and that sealingly abuts the housing and the curved ring to delimit a first pressure chamber and a second pressure chamber from each other, wherein the housing and the curved ring further delimit the first pressure chamber and the second pressure chamber, wherein the housing defines a high-pressure channel and a low-pressure channel distinct from the high-pressure channel, wherein rotation of the rotor enables a fluidic exchange connection between at least one of (i) the high-pressure channel and the plurality of operating chambers and (ii) the low-pressure channel and the plurality of operating chambers, and wherein the vane cell machine further comprises a pressure regulator that is fluidically connected to the first pressure chamber and the high-pressure channel to enable control of at least one of (i) a first pressure and (ii) a first volume flow of a pressurized fluid located in the high-pressure channel by applying pressure to the first pressure chamber.

3. The vane cell machine according to claim 2, wherein the second pressure chamber is in fluidic communication with the low-pressure channel.

4. A vane cell machine, comprising:

a rotor that is configured to rotate about a rotation axis;

a plurality of plate-like wings received in the rotor so as to be displaceable radially relative to the rotation axis, each pair of adjacent plate-like wings defining a corresponding operating chamber;

a curved ring that surrounds the rotor, and that delimits a movement path of the plate-like wings in an outward direction relative to the rotation axis;

a housing that surrounds the curved ring, and that enables displacement of the curved ring transversely relative to the rotation axis;

a first spring that is positioned between the curved ring and the housing, that is pretensioned, and that is configured to exert a first spring force that loads the curved ring transversely relative to the rotation axis; and a pressure piece that is positioned between the first spring and the curved ring, and that sealingly abuts the housing and the curved ring to delimit a first pressure chamber and a second pressure chamber from each other, wherein the housing and the curved ring further delimit the first pressure chamber and the second pressure chamber, wherein the curved ring defines a circular-cylindrical outer peripheral face, wherein the housing defines a circular-cylindrical inner peripheral face that is parallel with the circular-cylindrical outer peripheral face, wherein at least one of (i) the circular-cylindrical outer peripheral face and (ii) the circular-cylindrical inner peripheral face includes an abutment continuation, and wherein the curved ring sealingly contacts the housing at the abutment continuation so as to delimit the first pressure chamber and the second pressure chamber from each other.

5. The vane cell machine according to claim 4, wherein a first portion of the circular-cylindrical outer peripheral face that delimits the first pressure chamber is larger than a second portion of the circular-cylindrical outer peripheral face that delimits the second pressure chamber.

6. The vane cell machine according to claim 4, wherein an angle between the abutment continuation and the pressure piece with respect to the rotation axis is between 60° and 120°.

7. The vane cell machine according to claim 4, wherein the pressure piece defines a ninth sealing face that abuts an adapted region of the outer peripheral face of the curved ring.

8. A vane cell machine, comprising:

a rotor that is configured to rotate about a rotation axis;

a plurality of plate-like wings received in the rotor so as to be displaceable radially relative to the rotation axis, each pair of adjacent plate-like wings defining a corresponding operating chamber;

a curved ring that surrounds the rotor, and that delimits a movement path of the plate-like wings in an outward direction relative to the rotation axis;

a housing that surrounds the curved ring, and that enables displacement of the curved ring transversely relative to the rotation axis;

a first spring that is positioned between the curved ring and the housing, that is pretensioned, and that is configured to exert a first spring force that loads the curved ring transversely relative to the rotation axis; and a pressure piece that is positioned between the first spring and the curved ring, and that sealingly abuts the housing and the curved ring to delimit a first pressure chamber and a second pressure chamber from each other, wherein the housing and the curved ring further delimit the first pressure chamber and the second pressure chamber, and wherein the pressure piece is configured to engage the curved ring and the housing in a positive-locking manner so as to limit a rotation of the curved ring with respect to the rotation axis.

9. A vane cell machine, comprising:

a rotor that is configured to rotate about a rotation axis;

a plurality of plate-like wings received in the rotor so as to be displaceable radially relative to the rotation axis, each pair of adjacent plate-like wings defining a corresponding operating chamber;

a curved ring that surrounds the rotor, and that delimits a movement path of the plate-like wings in an outward direction relative to the rotation axis;

a housing that surrounds the curved ring, and that enables displacement of the curved ring transversely relative to the rotation axis;

a first spring that is positioned between the curved ring and the housing, that is pretensioned, and that is configured to exert a first spring force that loads the curved ring transversely relative to the rotation axis; and a pressure piece that is positioned between the first spring and the curved ring, and that sealingly abuts the housing and the curved ring to delimit a first pressure chamber and a second pressure chamber from each other, wherein the housing and the curved ring further delimit the first pressure chamber and the second pressure chamber, wherein the pressure piece defines a first sealing face and a second sealing face parallel to the first sealing face that are each planar relative to the rotation axis, wherein the housing defines a third sealing face and a fourth sealing face, wherein the first sealing face abuts the third sealing face and the second sealing face abuts the fourth sealing face, and wherein the curved ring abuts the third sealing face and the fourth sealing face.

10. The vane cell machine according to claim 9, wherein:

the pressure piece defines a fifth sealing face and a sixth sealing face parallel to the fifth sealing face;

the housing defines a seventh sealing face and an eighth sealing face;

the fifth sealing face abuts the seventh sealing face and the sixth sealing face abuts the eighth sealing face; and the first sealing face, the second sealing face, the fifth sealing face, and the sixth sealing face surround the pressure piece.

11. The vane cell machine according to claim 10, wherein:

the housing comprises a first housing portion, a second housing portion, and a third housing portion that are distinct from each other;

the first housing portion defines the third sealing face;

the second housing portion defines the seventh sealing face and the eighth sealing face; and the third housing portion defines the fourth sealing face.

12. The vane cell machine according to claim 9, wherein the vane cell machine is configured as a vane pump.

13. The vane cell machine according to claim 9, wherein the vane cell machine is configured as a vane motor.

* * * * *